US007138038B1

(12) United States Patent
Britton et al.

(10) Patent No.: US 7,138,038 B1
(45) Date of Patent: Nov. 21, 2006

(54) EXPANDABLE ANODE POD

(76) Inventors: James N Britton, 15822 Creek Hill La., Cypress, TX (US) 77429; William Jamrok, 16222 Shrewsbury Cir., Spring, TX (US) 77379; Michael Dolfay, 12414 Hideaway Park Dr., Cypress, TX (US) 77429

( * ) Notice: Subject to any disclaimer, the term of this patent is extended or adjusted under 35 U.S.C. 154(b) by 437 days.

(21) Appl. No.: 10/784,428

(22) Filed: Feb. 23, 2004

(51) Int. Cl.
*C23F 13/06* (2006.01)
*E02B 17/04* (2006.01)

(52) U.S. Cl. ..... 204/196.37; 204/196.36; 405/197; 405/202; 405/203; 405/211.1; 405/224

(58) Field of Classification Search ..... 405/197, 405/202, 211.1, 203, 224; 204/196.36, 196.37
See application file for complete search history.

(56) References Cited

U.S. PATENT DOCUMENTS 4,027,493 A * 6/1977 Guy, Jr. ..... 405/204
4,208,158 A * 6/1980 Davies et al. ..... 414/22.68
4,378,178 A * 3/1983 Roach ..... 405/224
4,645,379 A * 2/1987 Grimsley et al. ..... 405/210
4,837,992 A * 6/1989 Hashimoto ..... 52/118
5,051,037 A * 9/1991 Haney et al. ..... 405/227
5,380,130 A * 1/1995 Kessler et al. ..... 405/195.1
5,954,454 A * 9/1999 Bennett ..... 405/199

* cited by examiner

*Primary Examiner*—Bruce F. Bell
(74) *Attorney, Agent, or Firm*—Michael I. Kroll

(57) ABSTRACT

The present invention 10 discloses a collapsible pod for providing cathodic protection to a preferred structure 12. The present invention 10 has a top frame 20 and a bottom frame 22 with a plurality of folding leg segments 24 positioned therebetween. The leg segments are comprised of the anode material having a pivot 30 positioned at each distal end. Also extending between the top 20 and bottom 22 frame is the folded retaining means 28 that prevents random deployment of the structure. To expand the structure the folded retaining means 28 is disengaged whereby the top 20 and bottom 22 frame are spaced apart by the segmented leg elements 24. Also shown are stabilizers 26 and a rest channel 32 for the upper anode. Also disclosed is a lock bracket 34 forming a dual pivot point 30 for each leg segment 24. The lock bracket 34 provides means whereby each leg segment 24 lays in communication with each other adding rigidity to the folded structure. The lock bracket 34 has pins 45, 46 passing through a slot 52 in the guide bar extending from the distal ends of the leg segment 24. As the guide bar 50 moves into linear alignment with the lock bracket 30 the opposing guide bars move into the lock bracket and are then locked into the extended position.

14 Claims, 11 Drawing Sheets

EXPANDABLE ANODE POD

BACKGROUND OF THE INVENTION

1. Field of the Invention

The present invention relates generally to corrosion protection and, more specifically, to a sacrificial anode structure that is deployed underwater having a conductive member connecting the anode structure to a structure being protected. As the anode structure corrodes electrons are released that move by means of the conductor to the structure being protected forming cathodic protection for the structure The sacrificial anode structure is comprised of a folded expandable structure having folded retaining means to prevent random expansion of the structure until desired. In addition, dual purpose stacking guides allow multiple units to be stacked and locked together for land and offshore transportation. Units can be selectively unlocked for lifting or deployment. When on bottom or prior to deployment these arms may be deployed to provide stabilization.

The anode structure is comprised of a top and bottom frame having folded leg segments fastened therebetween. The leg segments are comprised of sections having pivot means positioned on each distal end of the segments.

To expand the sacrificial anode structure, the locking means is disengaged whereupon the top and bottom frame can be spaced apart by the extending leg segments. When the leg segments are linearly aligned, locking elements are inserted resulting in a rigid sacrificial anode structure.

Additionally, extra anode surface is deployed from hinged anodes protruding upwards from the upper frame. These may be deployed prior to launch.

2. Description of the Prior Art

While there are other sacrificial anode structures that may be suitable for the purposes for which they were designed, they would not be as suitable for the purposes of the present invention, as hereinafter described.

Therefore it is felt that a need exists for a folded extendable structure having leg comprised of segments having pivot means positioned on each distal end whereby said structure can be selectively expanded to form a rigid sacrificial anode structure.

Furthermore it is felt that a need exists for a folded extendible structure having folded retaining means whereby said folded structure can be moved in the folded state to a desired location and deployed to a designated position in the folded state whereupon the folded retaining means can be disengaged resulting in the extension of the leg segments until linearly aligned. Thereby enabling locking means to be inserted resulting in a rigid structure.

SUMMARY OF THE PRESENT INVENTION

The present invention discloses a collapsible pod for providing cathodic protection to a preferred structure. The present invention has a top frame and a bottom frame with a plurality of folding leg segments positioned therebetween. The leg segments are comprised of the anode material having a pivot positioned at each distal end. Also extending between the top and bottom frame is the folded retaining means that prevents random deployment of the structure. To expand the structure the folded retaining means is disengaged whereby the top and bottom frame are spaced apart by the segmented leg elements. Also shown are stabilizers and a rest channel for the upper anode. Also disclosed is a lock bracket forming a dual pivot point for each leg segment. The lock bracket provides means whereby each leg segment lays in communication with each other adding rigidity to the folded structure. The lock bracket has a pin passing through a slot in the guide bar extending from the distal ends of the leg segment. As the guide bar moves into linear alignment with the lock bracket the opposing guide bars move into the lock bracket and are then locked into the extended position.

A primary object of the present invention is to provide a sacrificial anode comprised of a foldable extendable structure.

Another object of the present invention is to provide a foldable extendable structure having a locking element for maintaining the folded position.

Yet another object of the present invention is to provide a foldable extendable structure having a frame forming the top surface.

Still yet another object of the present invention is to provide a foldable extendable structure having a frame forming the bottom surface.

A further object of the present invention is to provide a foldable extendable structure having legs extending between said top frame surface and said bottom frame surface. A yet further object of the present invention is to provide a foldable extendable structure wherein said legs are pivotally attached to said top and bottom frame.

A still yet further object of the present invention is to provide a foldable extendable structure having pivotally attached legs comprising segments that are pivotally attached to one another.

An additional object of the present invention is to provide a foldable extendable structure wherein said leg segments are substantially covered by an anodic substance.

Another object of the present invention is to provide a foldable extendable structure having legs wherein each leg is comprised of a plurality of anode material segments.

Yet another object of the present invention is to provide a foldable extendable structure wherein said leg segment have pivoting means positioned on each distal end.

Still yet another object of the present invention is to provide a foldable extendable structure having segmented legs wherein upon linear alignment of said segments locking elements can be employed to prevent pivotal movement.

A further object of the present invention is to provide a foldable extendable structure that can be moved from one location to another and deployed in said folded state until selective release of the locking element.

A yet further object of the present invention is to provide a foldable extendable structure that once the leg segments are linearly aligned locking elements can be employed resulting in a rigid structure.

A still yet further object of the present invention is to provide a foldable extendable structure having additional anode material segments pivotally fastened to the top of said structure.

An additional object of the present invention is to provide a foldable extendable structure wherein said additional anode material segments have means for fastening said additional segments in a deployed state.

Another object of the present invention is to provide a foldable extendable structure wherein said additional anode material segments are deployed by pivoting to a relative position transverse to the stored positioned and engaging a fastening element for holding said selective positioning.

Yet another object of the present invention is to provide stacker/stabilizers providing means for stacking one of the present invention on top of another ad infinitum wherein the stacker element has fastening means for engaging and holding the base of the adjoining anode pod until said fastening means is selectively released.

Still yet another object of the present invention is to provide a foldable extendable structure wherein said stacker\stabilizer is pivotal connected to said anode pod.

A further object of the present invention is to provide a foldable extendable structure wherein said stacker\stabilizer can be pivotally extended divergent to said anode pod.

A yet further object of the present invention is to provide a foldable extendable structure wherein said stacker\stabilizer is deployed by pivoting to a relative position divergent to the stored positioned wherein a fastening element is engaged to hold said selective positioning.

Additional objects of the present invention will appear as the description proceeds. The present invention overcomes the shortcomings of the prior art by providing a sacrificial anode structure comprising a folded extendable structure having a folded retaining means whereby said structure can be transported in a folded locked position to a destination and deployed in the folded locked position until selective release of the locking means whereby the legs comprised of a plurality of pivotal leg segments and fastened to an upper and lower frame members, extend until the segments are linearly aligned whereupon locking elements are employed resulting in a rigid structure.

Furthermore, said present invent provides for additional anode material segments pivotally fastened to the upper frame that can be selective pivoted from a stored position to an erect position and fixedly fastened in said position.

Additionally, the present invention provides means for stacking a plurality of anode pods having locking means for holding said stacked position and when said stacker locking element is released the stacker element can be pivotally moved to form a stabilizer element during the life of the anode pod.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
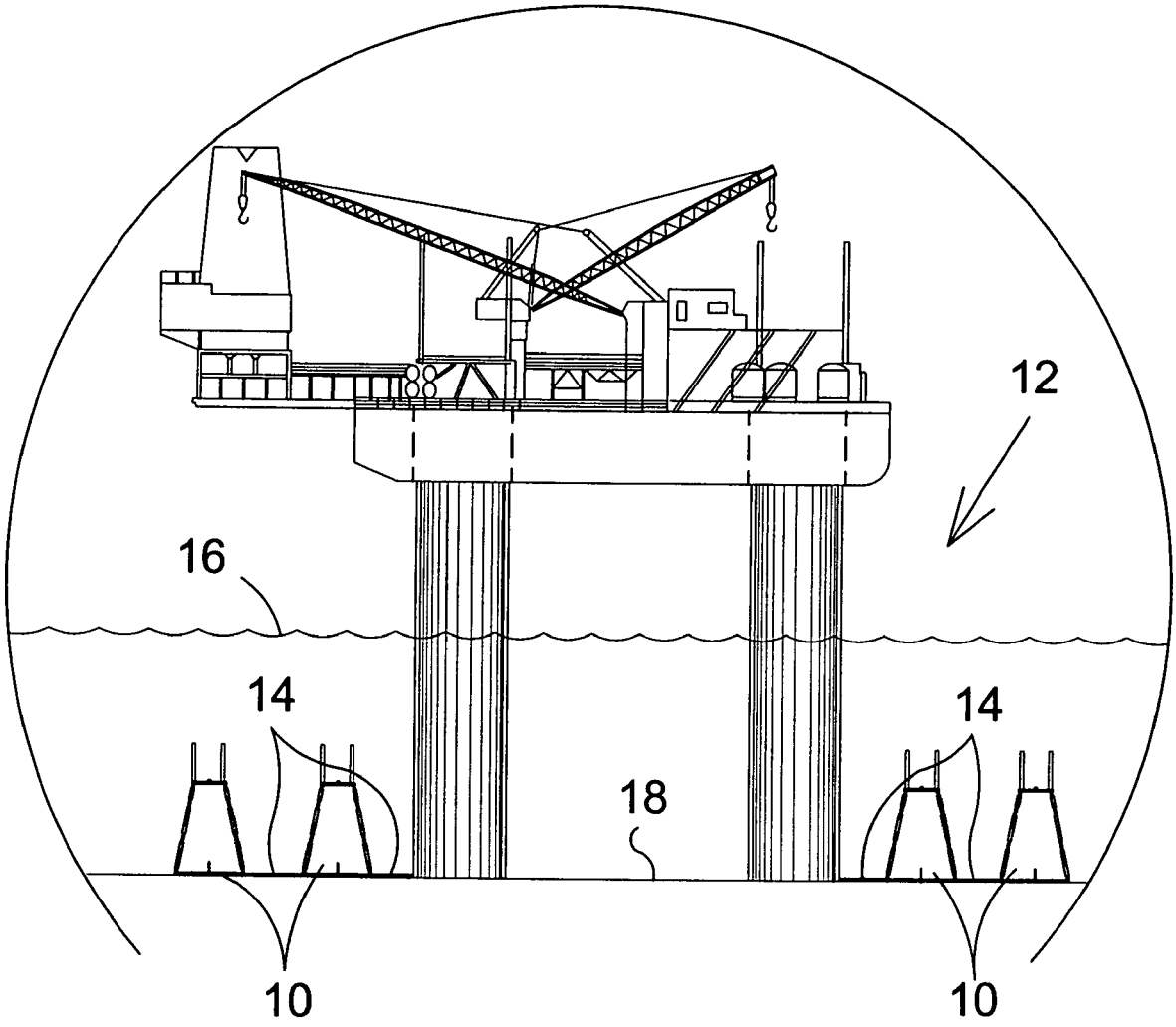
FIG. 1 is an illustrated view of the present invention in use.

With regard to reference numerals used, the following numbering is used throughout the drawings.

10 present invention
12 structure
14 cable
16 water level
18 sea floor
20 top frame
22 bottom frame
24 leg sections
26 stabilizer
28 lock pin
30 pivot point
32 rest channel
34 lock bracket
36 guide lock
38 locking pin aperture
40 stabilizer pin
42 stacker pin
44 stabilizer pivot pin
45 guide pin
46 locking pin
48 roller
50 guide bar
52 slot
54 threaded member
56 handle
58 platform

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrated view of the present invention 10 in use. Shown is a structure 12, e.g., on oil platform, exposed to elements that cause corrosion to occur. The present invention 10 is a structure that is calculated to corrode at a rate to provide the preferred structure 12 with a source of electrons to extend the life of the preferred structure. A person skilled in the art refers to this process as cathodic protection as a result of sacrificial anodes. While there are many current methods of providing cathodic protection, the present invention 10 provides a sacrificial anode structure that overcomes serious shortcomings of the current methods. The current sacrificial anodes are rigid structures that are shipped as large rigid frames requiring special handling constrained in size by the mode of transportation. The present invention 10 provides means for folding the sacrificial anode until selectively deployed on the job site. Also shown are cable 14, water level 16 and the sea floor 18.

Figure 2:
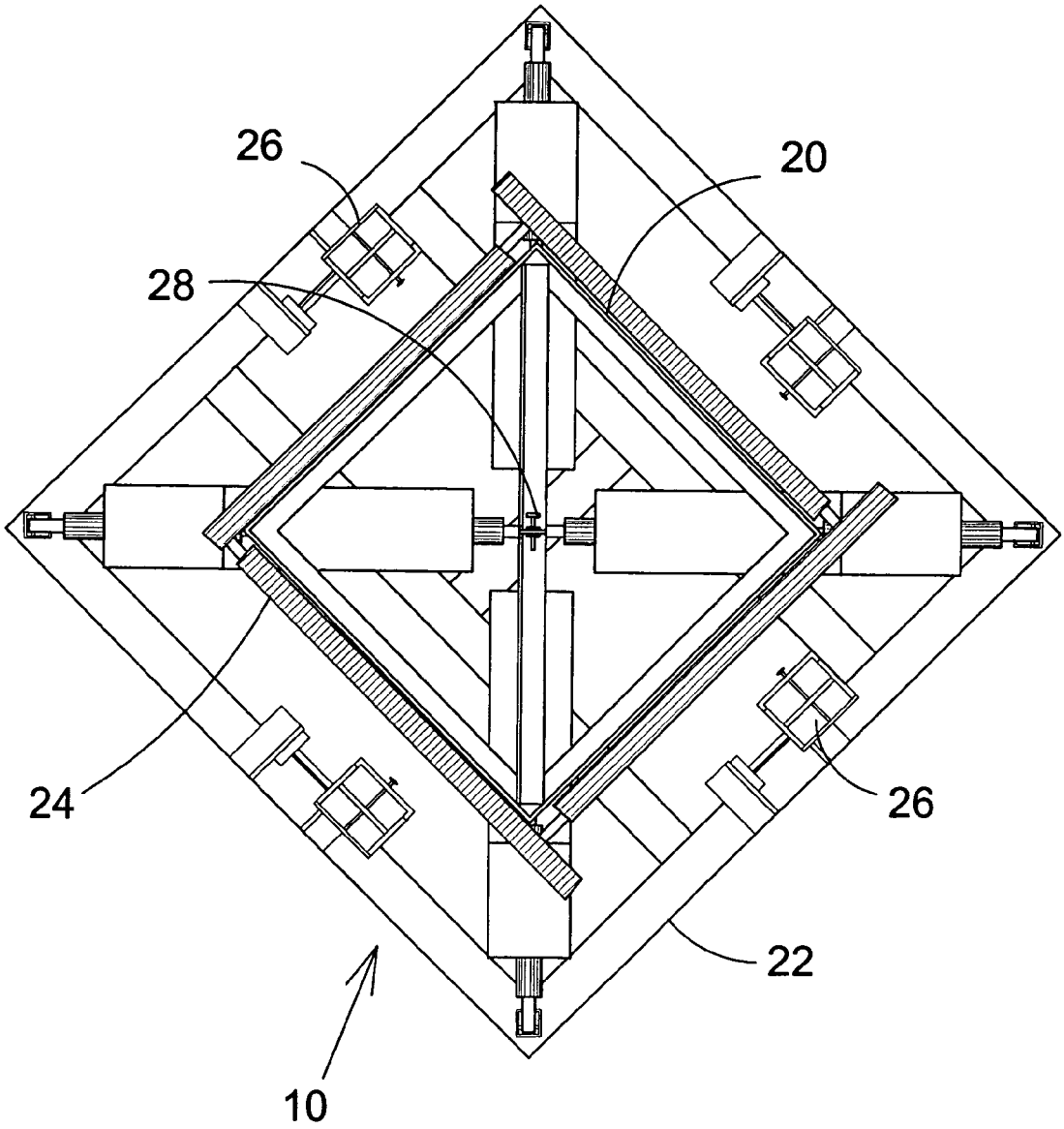
FIG. 2 is a top view of the folded sacrificial anode in the collapsed position.

Turning to FIG. 2, shown therein is a top view of the folded sacrificial anode 10 in the collapsed position. Shown is the sacrificial anode array having a top 20 and bottom 22 frame with multiple pivotal leg segments 24 fastened therebetween. In the folded position the top 20 and bottom 22 frame are spaced apart by the folded leg segments 24 and incorporate retaining means 28, e.g., a lock pin, for maintaining the structure in a folded form until selectively release. The top 20 and bottom 22 frames also provide a planar surface whereby the sacrificial structures can be stacked. Also shown are stabilizers 26.

Figure 3:
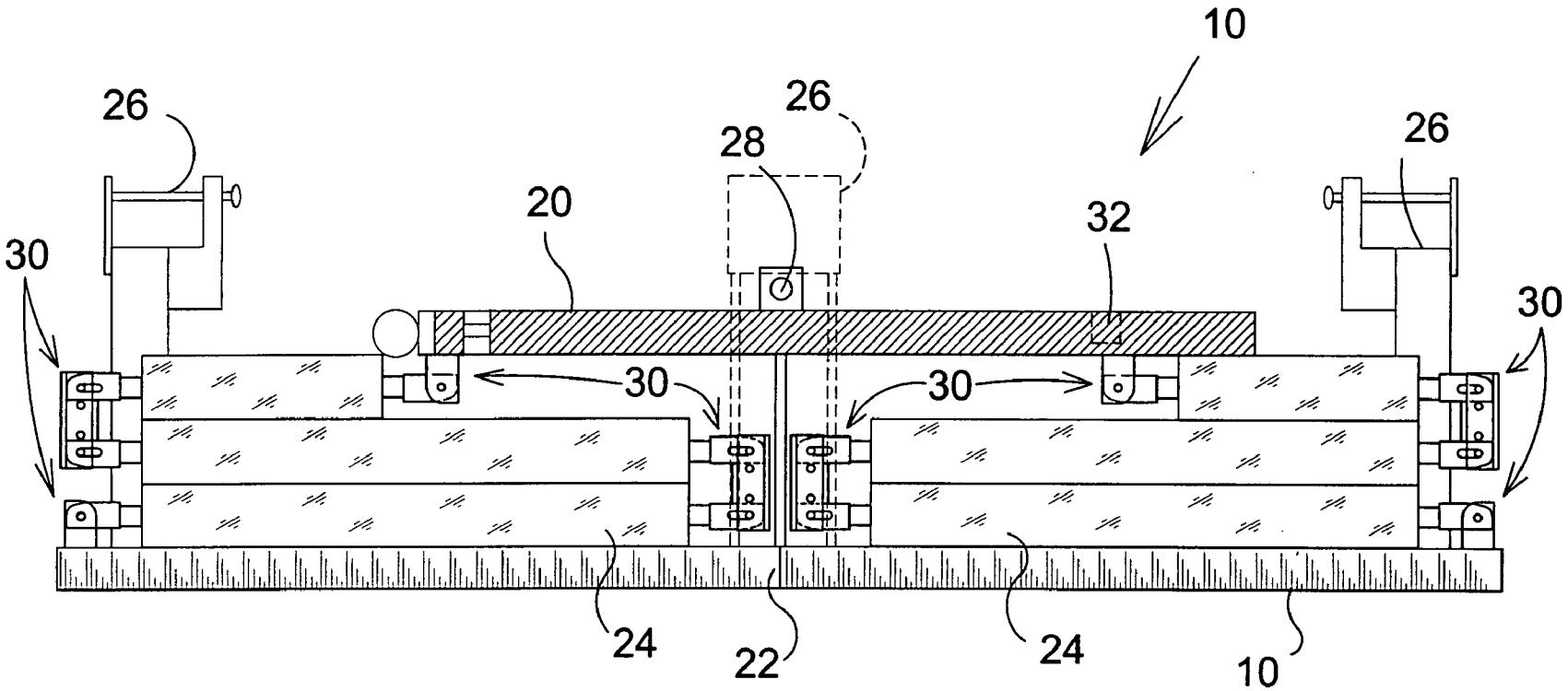
FIG. 3 is a side view of the collapsible pod of the present invention in the folded position.

Turning to FIG. 3, shown therein is a side view of the collapsible pod of the present invention 10 in the folded position. Shown is the present invention 10 in a folded position having a top frame 20 and a bottom frame 22 with a plurality of leg segments 24 positioned therebetween. The leg segments are comprised of the anode material having a plurality of pivots 30 positioned at each distal end. Also extending between the top 20 and bottom 22 frame is the folded retaining means 28 that prevents random deployment of the structure. To expand the structure the folded retaining means 28 is disengaged whereby the top 20 and bottom 22 frame are spaced apart by extending the segmented leg elements 24. Also shown are stabilizers 26 and a rest channel 32 for the upper anode.

Figure 4:
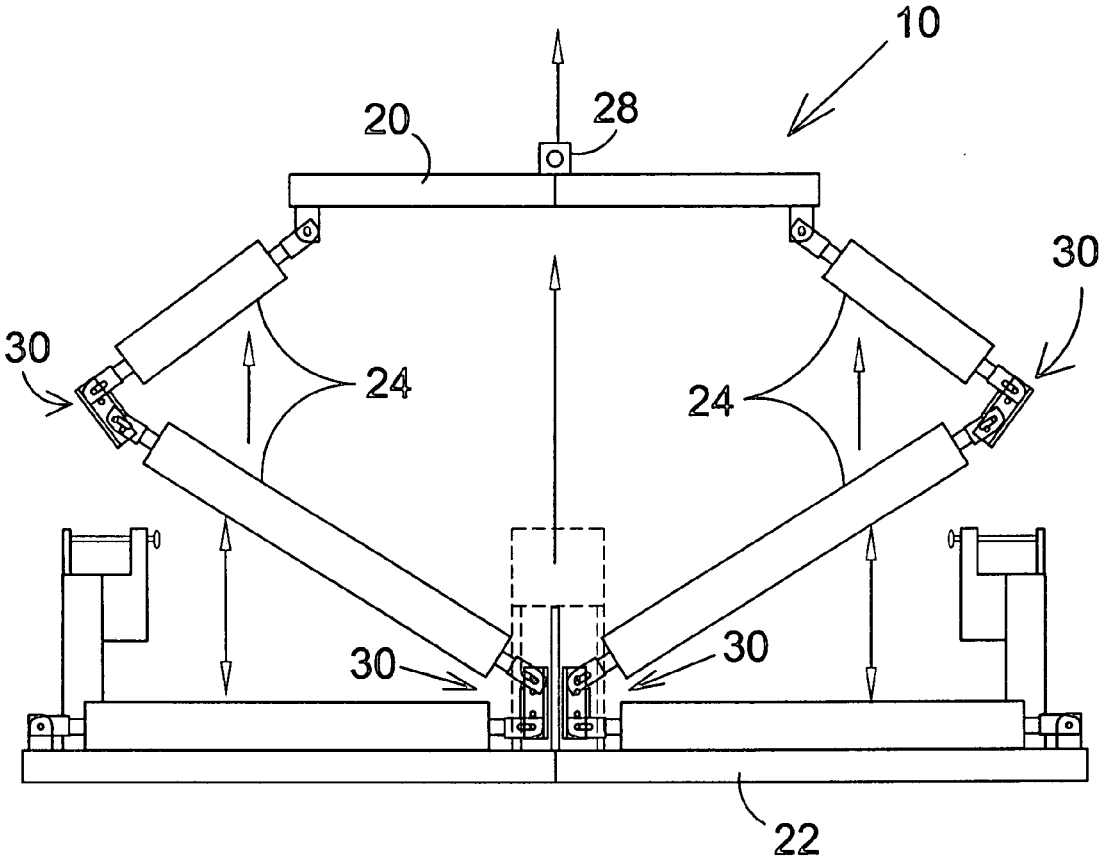
FIG. 4 is a side view of the present invention in the beginning stage of erection.

Turning to FIG. 4, shown therein is a side view of the present invention 10 in the beginning stage of erection. Shown is the sacrificial anode structure 10 having the folded retaining means 28 disengaged whereby the frames 20, 22 move apart by means of the pivotal joints 30 positioned at each distal end of the leg segments 24.

Figure 5:
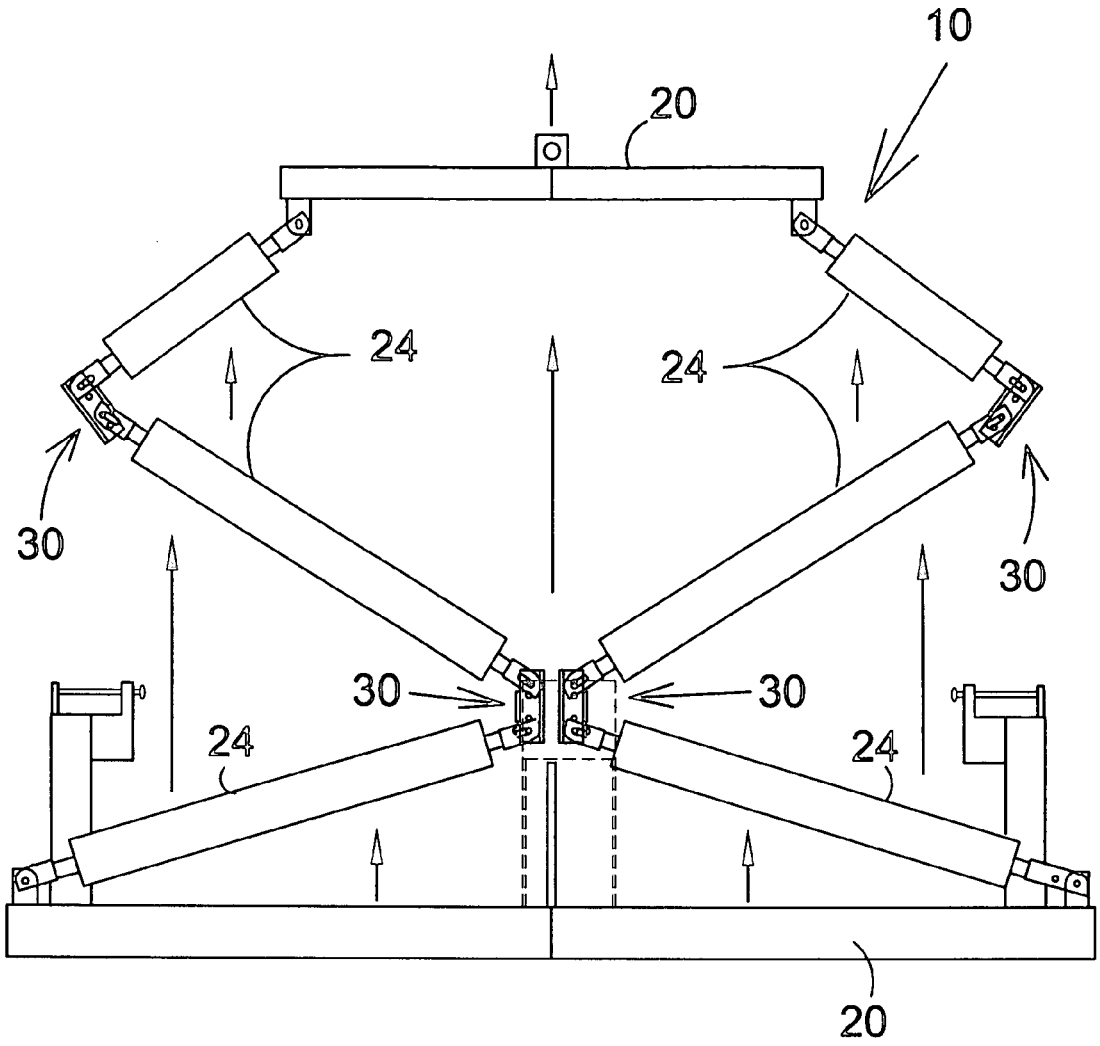
FIG. 5 is a side view of the present invention in a further stage of deployment.

Turning to FIG. 5, shown therein is a side view of the present invention 10 in a further stage of deployment. Shown is the present invention 10 being a collapsible structure of sacrificial anodes, e.g., legs 24, for seabed deployment that allows anode arrays to be deployed. The large anode array allows a great deal of cathodic protection capacity to be installed quickly and efficiently with minimum bottom time for divers. The structure 10 is linked such that it expands and locks when lifted by a vertical lift line from the surface. The unit is deployed to the seabed in the collapsed position with lock pin removed and then the unit is hoisted into an erect position. A diver then engages the lock guide brackets, the weight is then lowered to the seabed and the mechanical locks engage. A safety pin is installed and the lock guide brackets removed. The pod is then erect and ready for tie back with an electrical cable. Also shown are frames 20, 22, pivots 30, and legs 24.

Figure 6:
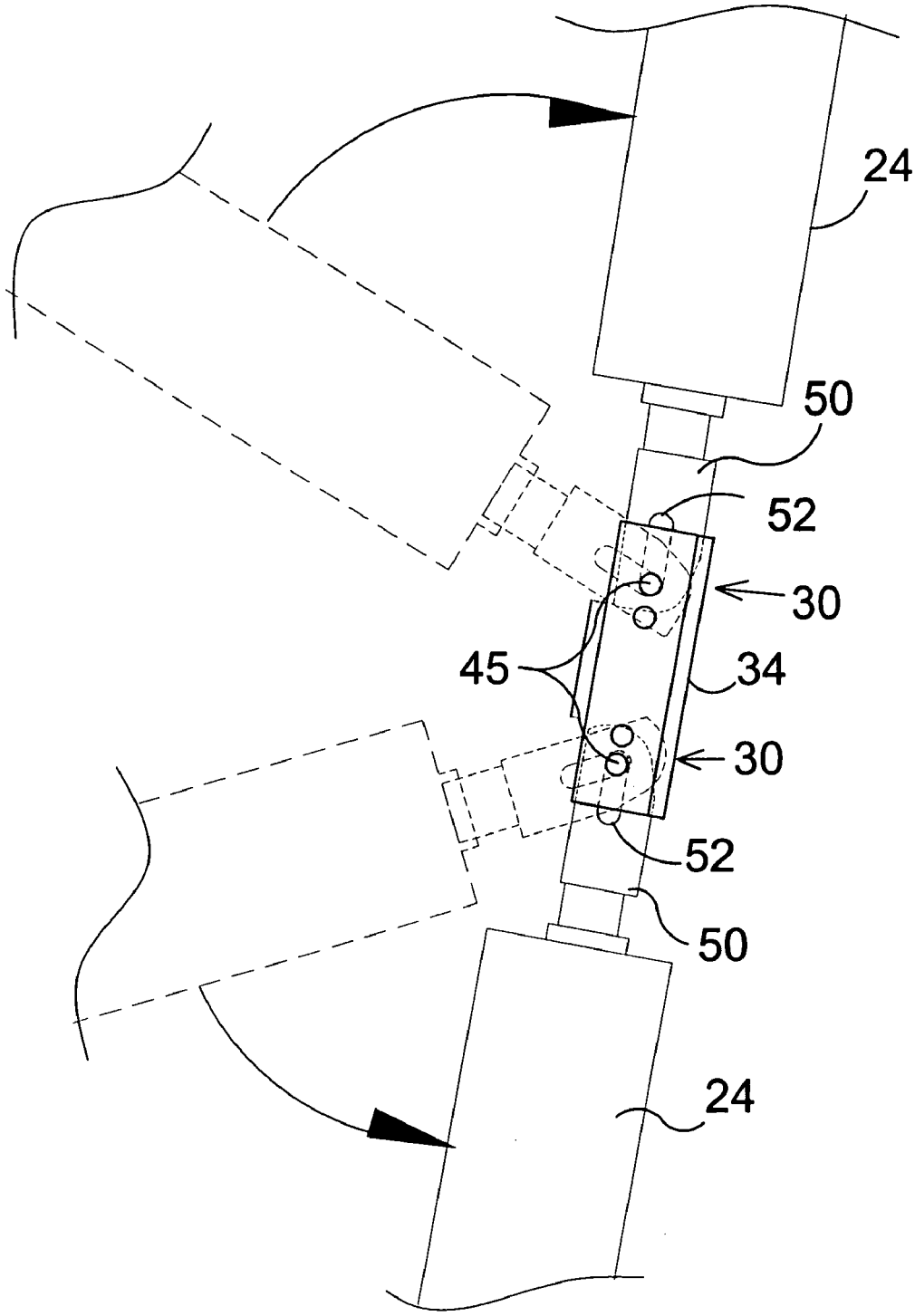
FIG. 6 is a detailed view of the lock bracket.

Turning to FIG. 6, shown therein is a detailed view of the lock bracket 34. Shown is the lock bracket 34 forming a dual pivot point 30 for each of adjacent leg segments 24. The lock bracket 34 provides means whereby each of a pair of leg segments 24 lay in communication with each other and when locked in position add rigidity to the folded structure. The lock bracket 34 has a guide pin 45 passing through an elongated slot 52 in the guide bar 50 extending from the distal ends of the leg segments 24. As one of the guide bars 50 moves into linear alignment with the lock bracket 34 the opposing guide bars 50 move inwardly into the cavity internal the cylindrical lock bracket 34.

Figure 7:
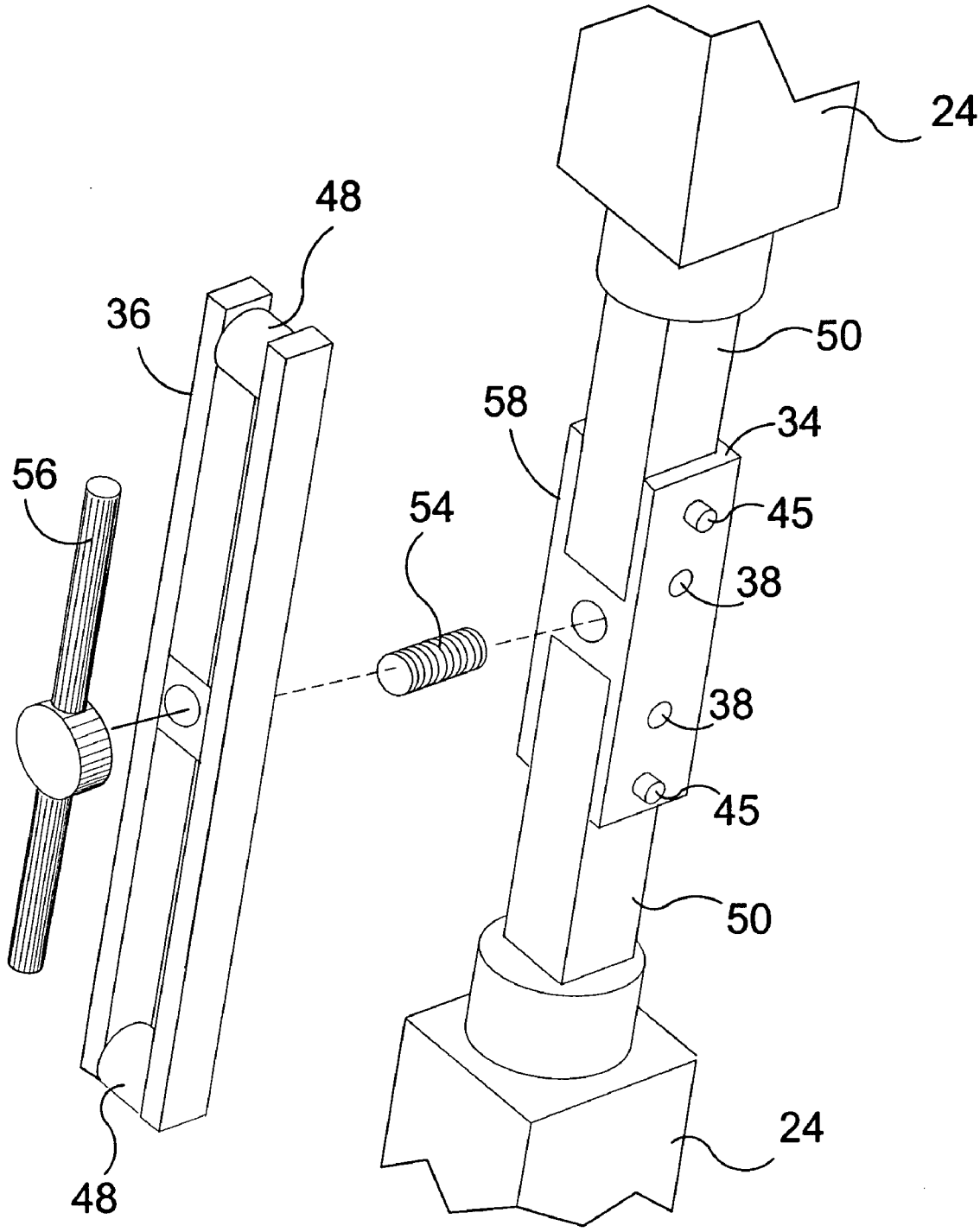
FIG. 7 is an enlarged view of the guide lock.

Turning to FIG. 7, shown therein is an enlarged view of the guide lock 36. Once the guide bars 50 are seated as a platform 58 within the lock bracket 34, the guide lock 36 is fastened to the lock bracket 34 using member 54 with handle 56. The guide lock 36 provides means for fully seating the guide bars 50 within the lock bracket 34 having rollers 48 positioned on each distal end for engaging opposing leg segments 24 or anode element. Once tangential forces have been removed the weight of the structure will cause the guide bars 50 to seat within the lock bracket 34 and the guide locks 36 can then be removed. Also shown is the locking pin aperture 38 for receiving the lock pin 46 (not shown) and guide pins 45.

Figure 8:
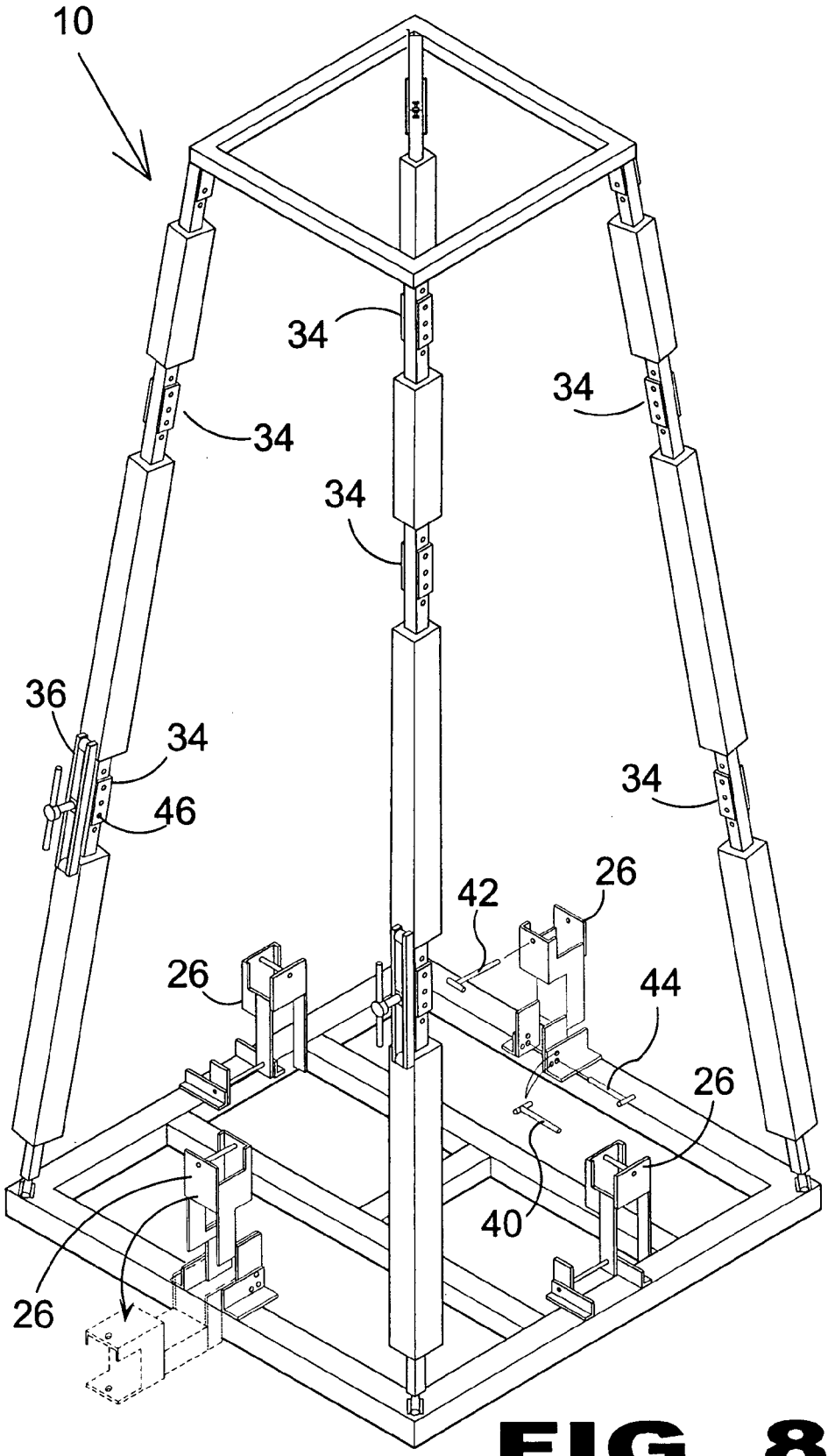
FIG. 8 is a perspective view of the present invention.

Turning to FIG. 8, shown therein is a perspective view of the present invention 10. Shown is the present invention 10 being a collapsible structure of sacrificial anodes for seabed deployment that can form anode arrays. The large anode array allows a great deal of cathodic protection capacity to be installed quickly and efficiently with minimum bottom time for divers. The structure 10 is linked such that it expands and locks when lifted by a vertical lift line from the surface. The unit is deployed to the seabed in the collapsed position with lock pin 28 (not shown) removed and then the unit is hoisted into an erect position. A diver then engages the lock brackets 34 and the weight is then lowered to the seabed and the mechanical locks engage. A safety pin 46 is installed and the guide lock 36 removed. The pod is then erect and ready for tie back with an electrical cable (not shown but see FIG. 1). Also shown are stabilizers 26, stabilizer pin 40, stacker pin 42, and stabilizer pivot pin 44.

Figure 9:
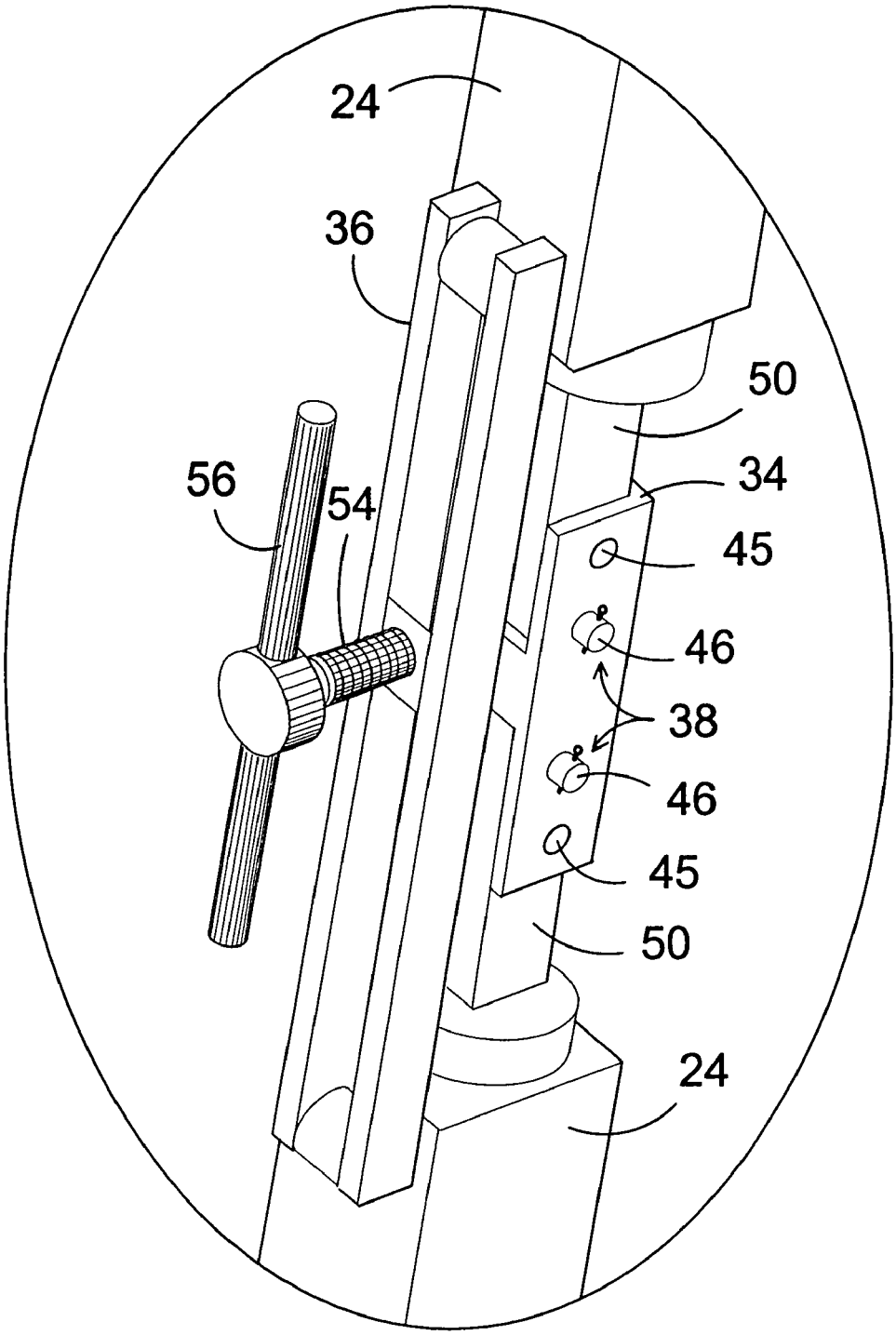
FIG. 9 is an enlarged view of guide lock engaging opposing leg segments.

Turning to FIG. 9, shown therein is an enlarged view of guide lock 36 engaging opposing leg segments 24. Shown is the guide lock 36 fastened to the lock bracket 34 using a threaded member 54 with handle 56 thereon and engaging opposing leg segments 24 whereby the leg segment guide pins 45 seat within the lock bracket 34. The lock bracket 34 has a second locking pin aperture 38 passing through opposing sides providing means for inserting a locking pin 46. The locking pin 46 is positioned to pass through the opposing end of the guide bar 50 slot preventing any vertical movement of the leg segment 24 having a guide pin 45 positioned at the apex and through the guide bar slotted aperture which is now encompassed by the lock bracket 34 and is not now visible.

Figure 10:
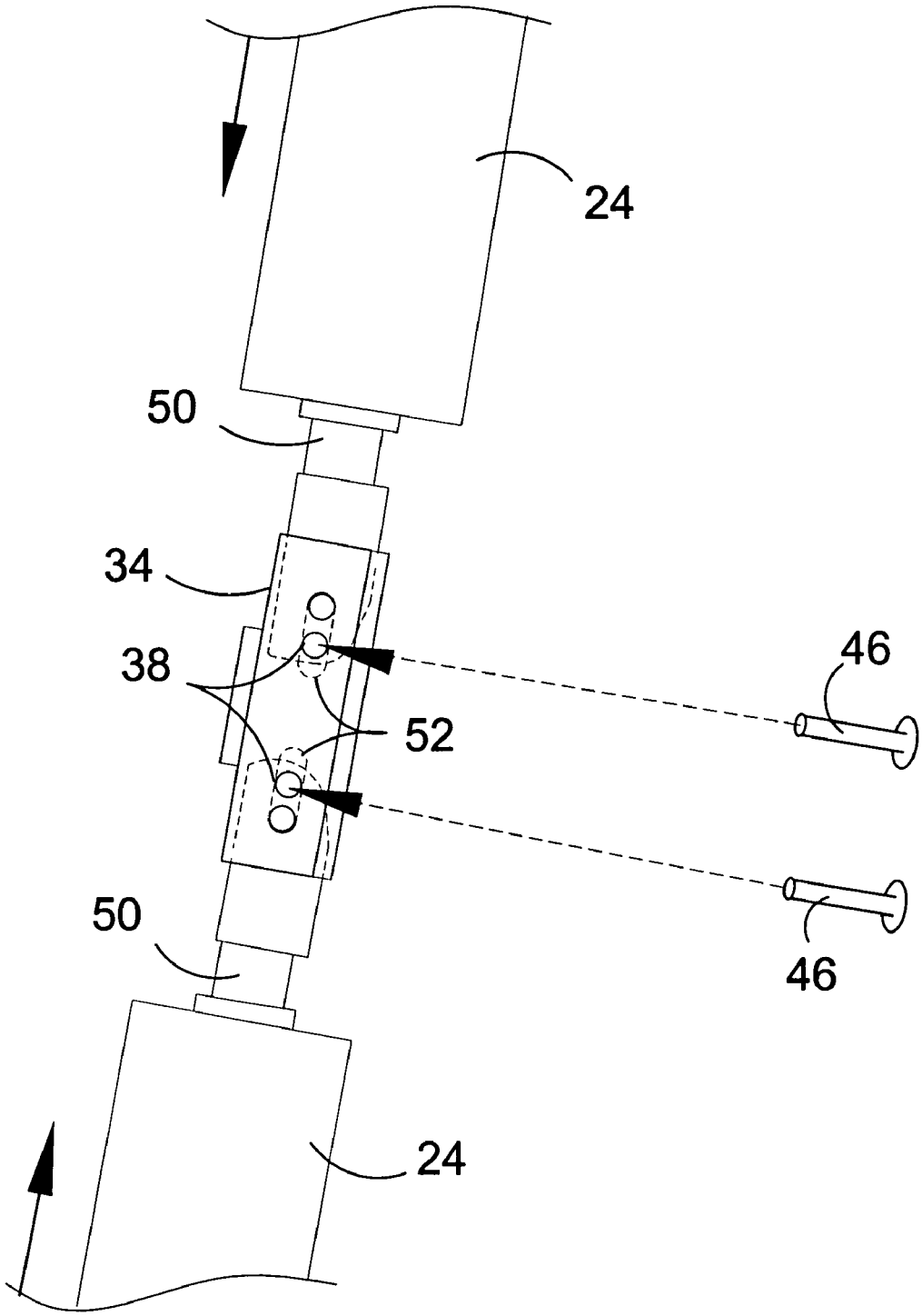
FIG. 10 is a detailed view of a locked leg segment.

Turning to FIG. 10, shown therein is a detailed view of a locked leg segment 24. Shown are opposing leg segments 24 having a guide bar 50 positioned on their distal ends. The guide bar 50 has an elongated slotted aperture 52 whereby the leg segments 24 are fixedly attached to a lock bracket 34. The lock bracket 34 has opposing sides with a locking safety pin 46 passing through the guide bar 50. One of the adjacent sides of the lock bracket 34 has a centrally positioned plate 58 (not shown) forming a platform for the attachment of the guide lock which serves to provide means for aligning the guide bars 50 within the centrally disposed cavity of the lock bracket 34. Once aligned, the guide bars 50 will seat within the lock bracket 34 whereupon the locking pins 46 can be inserted through the locking pin apertures 38.

Figure 11:
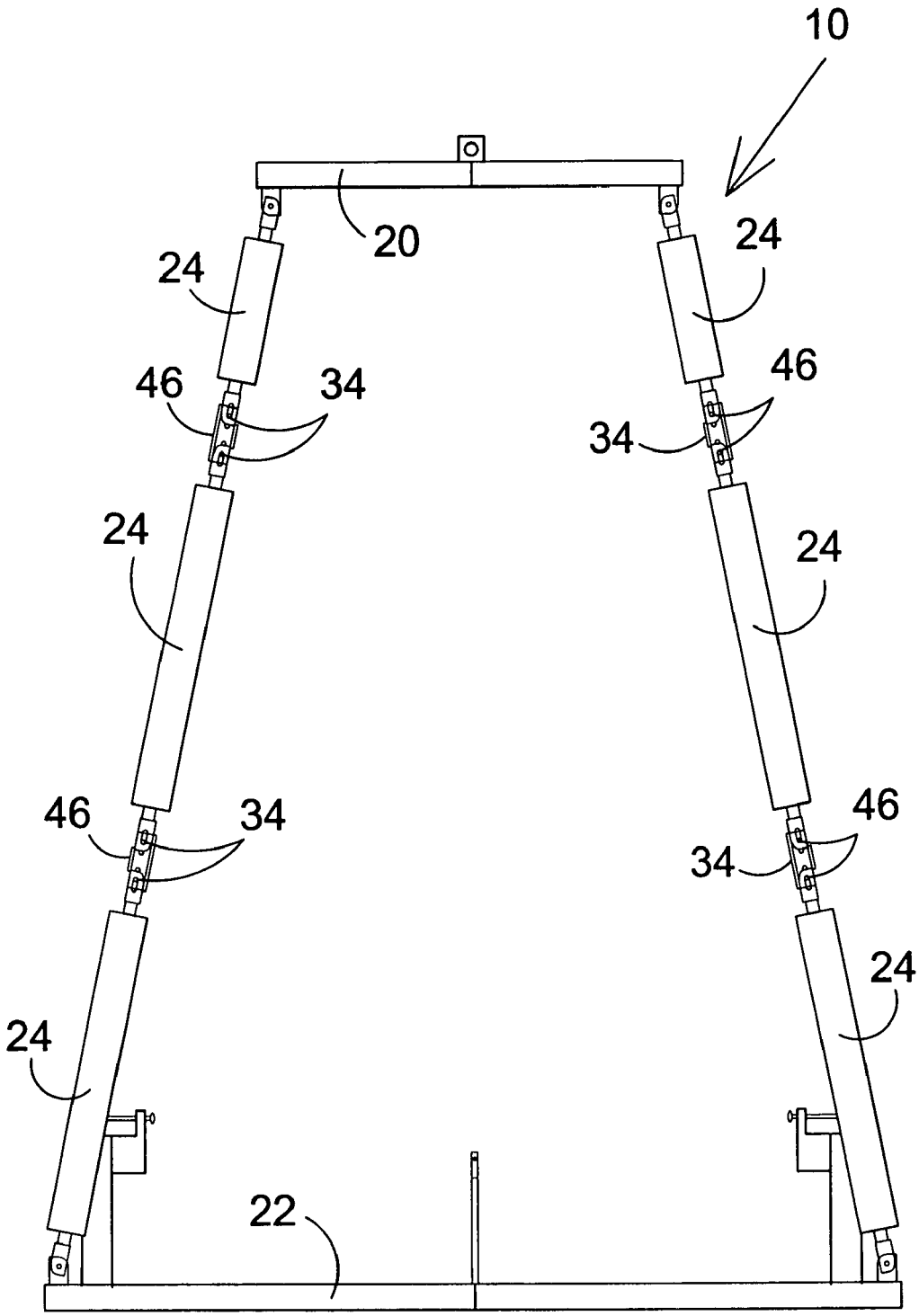
FIG. 11 is a side view of the anode structure of the present invention in a fully erected position.

Turning to FIG. 11, shown therein is a side view of the anode structure of the present invention 10 in a fully erected position. Shown is the present invention 10 being a collapsible structure of sacrificial anodes for seabed deployment whereby a folded locked structure can be shipped in a compact form to a destination and deployed in a folded state until selective release of the locking means allows the top 20 and bottom 22 frame to become spaced apart by means of the leg segments 24. The weight of the structure 10 will cause the leg segments 24 to seat with a lock bracket 34 whereupon a guide lock can be attached to the lock bracket providing means for aligning the guide bar slotted aperture with the lock bracket aperture whereby a locking pin 46 is inserted therein resulting in a rigid structure.

We claim:

1. A foldable anode pod for providing cathodic protection to a preferred structure, comprising:

a) a top frame having a plurality of sides and upper and lower surfaces;

b) a bottom frame having a plurality of sides and upper and lower surfaces, wherein said bottom frame can be disposed on a sea floor proximate to the preferred structure;

c) a plurality of folding legs for joining said top frame to said bottom frame, wherein said legs in a first position are folded so that said top frame is disposed adjacent said bottom frame, wherein said legs in a second position are extended to be linearly aligned with each other so that said top frame is disposed away from said bottom frame, wherein said legs are positioned in said second position when the anode pod is disposed on a sea floor;

d) means for locking said top frame to said bottom frame whereby the top frame is secured to the bottom frame when the legs are in the first position;

e) means for connecting said legs to said top and bottom frames whereby the legs are pivotally connected to the top and bottom frames; and, f) means for connecting said legs to each other whereby the leg segments can be connected to each other and the leg segments can be locked together so that the legs are secured when the legs are in the second position.

2. The anode pod of claim 1, further comprising an electrical connector for joining the anode pod to the preferred structure.

3. The anode pod of claim 2, further comprising a plurality of stabilizer arms each having a first end adapted for attachment in a spaced apart manner around said bottom frame and each having a second end adapted to be deployed on a sea floor to permit the anode pod to be stabilized when the anode pod is disposed on a sea floor.

4. The anode pod of claim 3, wherein said means for locking comprises:

a) wherein said top frame has a member having a first aperture therein;

b) wherein said bottom frame has a member having a second aperture therein, wherein said second aperture is in operative alignment with said first aperture when the legs are in the first position; and, c) a lock pin for being placed in said first and second aperture to lock the top frame to the bottom frame and thereafter said lock pin is removed from said first and second apertures to permit the top frame to be disposed away from the bottom frame.

5. The anode pod of claim 4, wherein said means for connecting said legs to said top and bottom frames comprises a pivotable joint.

6. The anode pod of claim 5, wherein said means for connecting said legs to each other comprises a lockable pivotable joint to permit the adjacent legs to be folded into the first position and to be locked when the legs are in the second position so that the legs are secured in the second position.

7. The anode pod of claim 6, wherein said lockable pivotable joint further comprises:

a) wherein each end of said adjacent leg segments have a guide bar disposed on said end, each of said guide bars having an elongated aperture therein;

b) a lock bracket being a cylindrical member open on each end having a pair of guide pins being transversely disposed therein, one each of said guide pins being disposed in one each of said elongated apertures of each guide bar to permit the guide bars to be pivotally attached to the lock bracket, said lock bracket having two pair of opposing transverse apertures therein;

c) a first locking pin being disposed in said first pair of transverse apertures so as to pass through said elongated aperture to permit one of said adjacent leg segments to be locked into the second position; and, d) a second locking pin being disposed in said second pair of transverse apertures so as to pass through said elongated aperture to permit the other of said adjacent leg segments to be locked into the second position.

8. The anode pod of claim 7, further comprising a guide lock adapted for attachment to said lock bracket to provide a temporary support member for said lock bracket to permit the first and second locking pins to be disposed in the transverse apertures and then thereafter the guide lock is removed.

9. The anode pod of claim 8, wherein said top frame and said bottom frame comprise four sides.

10. The anode pod of claim 9, wherein one of said folding legs is disposed on each of said corners of said top and bottom frames.

11. The anode pod of claim 10, wherein one of said first ends of each said stabilizers are disposed on one side of said bottom frame.

12. The anode pod of claim 11, wherein said stabilizers are pivotally attached to said bottom frame to permit the stabilizers to be pivoted laterally away from said bottom frame.

13. The anode pod of claim 12, wherein each of said stabilizers has a first stabilizer aperture therein, wherein each of said sides of said bottom frame has a second stabilizer aperture therein, wherein each said first stabilizer apertures is operatively aligned with a corresponding second stabilizer aperture, wherein a stabilizer pin is placed in said first and second stabilizer apertures to permit the stabilizer to be locked into position on the bottom frame.

14. The anode pod of claim 13, wherein said sides of bottom frame are longer than said sides of said top frame to permit the anode pod to stand upright on the sea floor.

* * * * *